United States Patent [19]

Smith

[11] Patent Number: 4,671,745

[45] Date of Patent: Jun. 9, 1987

[54] MAGNETICALLY-ACTIVATED MOTORIZED PUMP

[76] Inventor: Raymond H. Smith, Rte. 2, 5AAA, Larned, Kans. 67550

[21] Appl. No.: 842,674

[22] Filed: Mar. 21, 1986

[51] Int. Cl.[4] ..... F04B 17/00

[52] U.S. Cl. ..... 417/419; 417/420; 417/533; 310/80

[58] Field of Search ..... 417/419, 420, 418, 415, 417/417, 533; 310/80, 103, 24

[56] References Cited

U.S. PATENT DOCUMENTS

| | | | |
|---|---|---|---|
| 516,840 | 3/1894 | Robinson . | |
| 1,229,009 | 6/1917 | Allison . | |
| 1,657,378 | 1/1928 | Dourson | 417/533 |
| 1,906,405 | 5/1933 | Patrick | 417/533 |
| 2,790,095 | 4/1957 | Peek et al. . | |
| 3,405,641 | 10/1968 | Coberly . | |
| 3,754,154 | 8/1973 | Massie | 310/30 |
| 3,791,770 | 2/1974 | Farkos | 417/418 |
| 3,811,058 | 5/1974 | Kiniski | 310/80 |
| 3,884,125 | 5/1975 | Massie | 92/13.5 |
| 3,967,146 | 6/1976 | Howard | 310/103 |
| 3,992,132 | 11/1976 | Putt | 417/271 |
| 4,011,477 | 3/1977 | Scholin | 310/80 |
| 4,272,226 | 6/1981 | Osborne | 417/418 |
| 4,297,086 | 10/1981 | McGowan | 417/271 |
| 4,523,114 | 6/1985 | Smith | 310/24 |

FOREIGN PATENT DOCUMENTS

| | | | |
|---|---|---|---|
| 79688 | 6/1980 | Japan | 417/415 |
| 106084 | 8/1980 | Japan | 417/420 |
| 49376 | 3/1982 | Japan | 310/103 |

*Primary Examiner*—Carlton R. Croyle
*Assistant Examiner*—Donald E. Stout
*Attorney, Agent, or Firm*—Litman, Day & McMahon

[57] ABSTRACT

A magnetically-actuated, motorized pump includes a plurality of cylinders extending at radially-spaced intervals between first and second heads. Each cylinder reciprocably receives a piston assembly including a pair of permanent magnets with outwardly-extending poles. Inlet and outlet valves are each provided at opposite ends of the cylinders. First and second rotors are each rotatably mounted at a respective end of the pump outside of a respective head. Each rotor includes a concentric ring comprising alternating permanent magnets and electromagnets for reciprocating the piston assemblies. Perimeter magnets are provided on the first rotor and the first head for interacting whereby rotary motion is imparted to the rotors. The electromagnets are actuated by an electrical distribution system.

16 Claims, 5 Drawing Figures

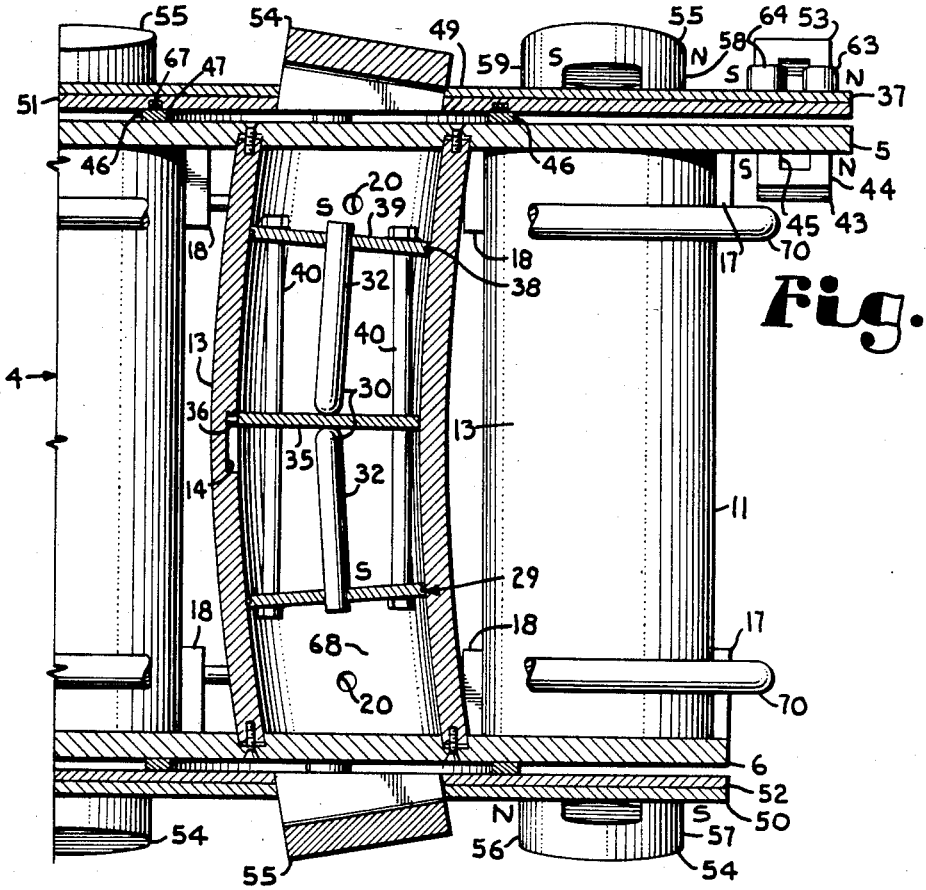
Fig. 3.
Fig. 4.
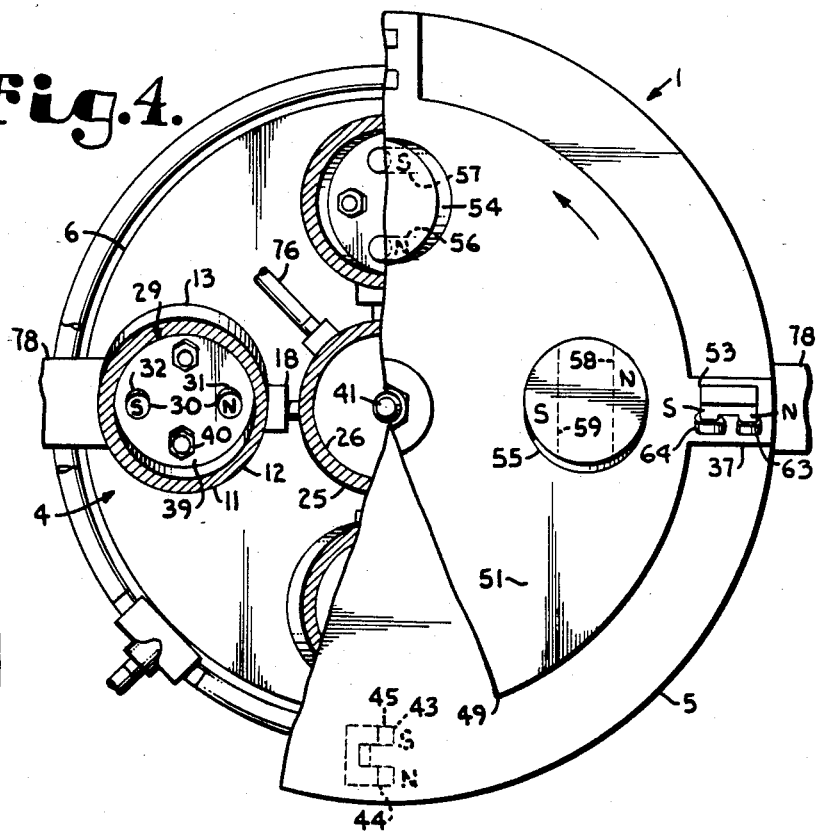
Fig. 5.
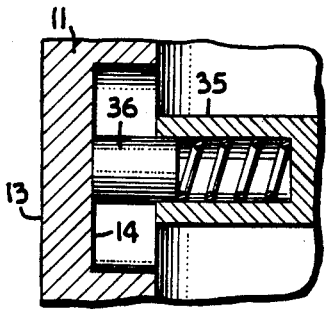

MAGNETICALLY-ACTIVATED MOTORIZED PUMP

BACKGROUND OF THE INVENTION

1. Field of the Invention

The present invention relates generally to motors and pumps and in particular to a magnetically-actuated, motorized, reciprocating pump.

2. Description of the Prior Art

A wide variety of pumps and compressors have heretofore been devised to meet the requirements of diverse applications requiring fluid pumping or compression. Reciprocating pumps and compressors generally include cylinders with pistons slidably disposed therein. The pistons may be reciprocated by, for example, electric motors or internal combustion engines.

It has also heretofore been proposed to integrally combine the mechanism for reciprocating the piston or pistons with the pump itself. For example, the Smith U.S. Pat. No. 4,534,714 discloses a fluid operating device wherein a pair of pistons are slidably disposed in a cylinder assembly. Opposed pairs of electromagnets are mounted on the pistons and reciprocate them when energized. Thus, the pump mechanism and the prime mover required therefor are combined in a single, relatively simple device.

The present invention likewise combines these functions in a single device and employs magnetic attraction and repulsion for reciprocating the pistons. Heretofore there has not been available a magnetically-actuated motorized pump or compressor with the advantages and features of the present invention.

SUMMARY OF THE INVENTION

In the practice of the present invention, a magnetically-actuated motorized pump is provided which includes a plurality of cylinders extending between first and second heads. Each cylinder receives a piston assembly reciprocably mounted therein and including a pair of permanent magnets with outwardly-extending poles. Each cylinder end includes respective inlet and outlet valves. First and second rotors are rotatably mounted on each end of the pump outside of the first and second heads respectively. Each rotor includes a respective ring of alternating permanent magnets and electromagnets with poles adapted for selectively aligning with the poles of respective piston assembly permanent magnets whereby the piston assemblies are reciprocated within their respective cylinders. Perimeter magnets are located on the first head and the first rotor and are adapted for imparting rotary motion to the rotors, which are interconnected by a concentric rotor shaft. An electrical distribution system is provided whereby the electromagnets are selectively energized. The fluid may be used for driving, for example, an hydraulic motor.

OBJECTS OF THE INVENTION

The principal objects of the present invention are: to provide a magnetically-actuated motorized pump; to provide such a pump which includes pistons reciprocably received in cylinders; to provide such a pump wherein fluid is utilized to enhance magnetic attraction and repulsion; to provide such a pump wherein the fluid is utilized for cooling permanent magnets for greater effectiveness; to provide such a pump wherein the fluid lubricates the moving parts; to provide such a pump which incorporates the functions of a prime mover unit and a pump unit in a single device; to provide such a pump which is efficient in operation, economical to manufacture, easy to repair, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

BRIEF DESCRIPTION OF THE DRAWINGS

FIG. 3 is a fragmentary, longitudinal cross-section of the motorized pump particularly showing the orientation of the cylinders.

FIG. 4 is a plan view of the motorized pump with portions broken away to reveal internal construction.

FIG. 5 is an enlarged detail of a guide pin arrangement for a piston assembly of the motorized pump.

DETAILED DESCRIPTION OF THE PREFERRED EMBODIMENTS

Figure 1:
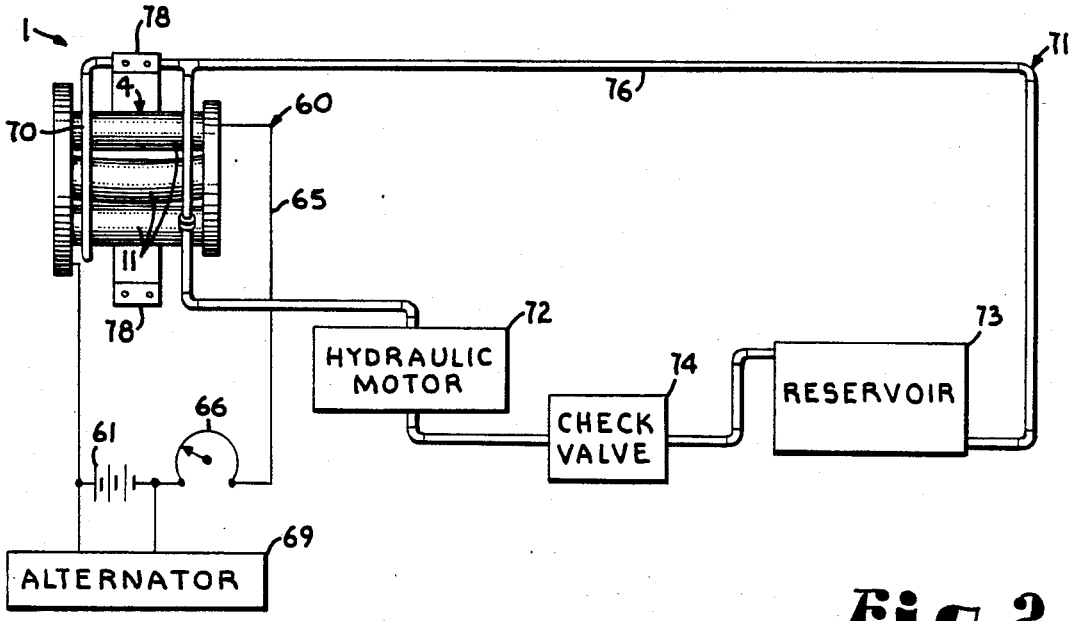
FIG. 1 is an electrical and hydraulic schematic of a system including a motorized pump comprising the present invention.
Figure 2:
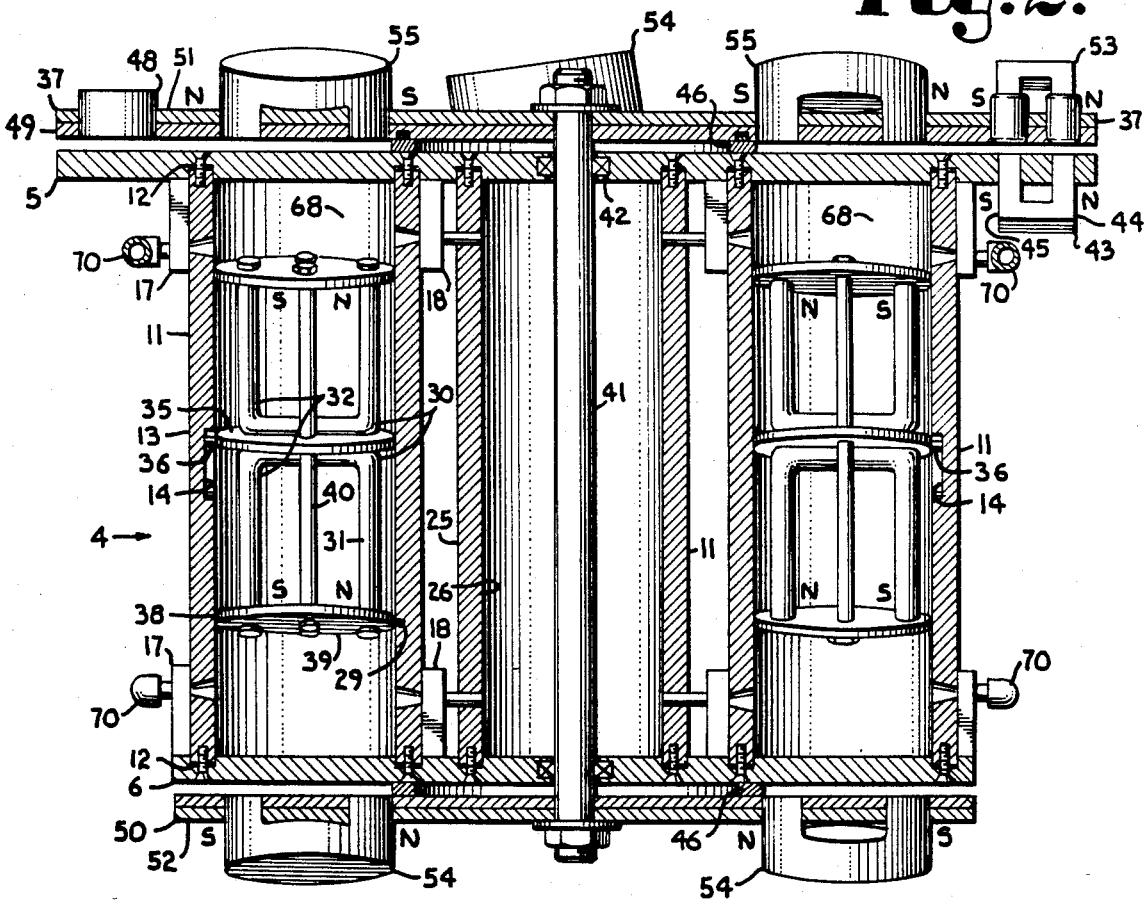
FIG. 2 is a longitudinal cross-section of the motorized pump.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, the reference numeral 1 generally designates a motorized pump comprising the present invention. Although the invention is referred to herein as a pump, it is to be understood that it could also function as a compressor.

The pump 1 generally comprises a cylinder assembly 4 centrally disposed between first and second heads 5, 6 and first and second rotors 49, 50.

The cylinder assembly 4 includes a plurality (four are shown) of individual cylinders 11 radially arranged around a central, rotational axis of the pump 1. Each cylinder 11 includes opposite ends 12 and a midsection 13 and comprises a nonferrous material, for example, aluminum. Three longitudinally extending grooves 14 open into the interior of each cylinder 11 at its respective midsection 13 and are positioned at 120° intervals.

At each end of the cylinders 11 are inlet and outlet valve assemblies 17, 18 respectively. The valve assemblies 17, 18 are automatically actuated by a fluid pressure differential. The valve assemblies 17, 18 communicate with the interiors of respective cylinders 11 through inlet and outlet orifices 19, 20.

Located inwardly from the circle of cylinders 11 is a coaxial, central tube 25 defining an outlet fluid chamber 26 therein. The central tube 25 extends between the head assemblies 5, 6 and communicates with the outlet valves 18.

A respective piston assembly 29 is reciprocably disposed within each cylinder 11 and comprises a pair of horseshoe-shaped permanent magnets 30 each having north and south poles 31, 32. The magnets 30 are connected with their respective poles 31, 32 extending outwardly from the piston assemblies 29 towards the cylinder ends 12. The magnets 30 are joined at a circular magnet spacer 35 with three springloaded, retractable guide pins 36 which protrude from the magnet spacer 35 and are slidably received in respective cylinder grooves 14.

Each piston assembly 29 includes a pair of piston discs 39 each mounted on the poles 31, 32 of a respective magnet 30 and having a compressible ring 38 slidably received in a relatively close-fitting engagement with the cylinder 11. The rings 38 are coated with tetrafluoroethylene (TFE) for reduced friction. The piston assemblies 29 are secured together by piston bolts 40.

Each head 5, 6 is secured to respective cylinder ends 12 and the central tube 25 in a fluid-tight engagement. An electrical contact ring 46 including radially-spaced, electrical contacts 47 is concentrically located on the first head 5.

The rotors 49, 50 are mounted on opposite ends of the pump 1 in closely-spaced, parallel relation to the respective heads 5, 6. Each rotor 49, 50 includes a respective rotor plate 51, 52 and a concentric ring of alternating permanent magnets 54 with north and south poles 56, 57 and electromagnets 55 with north and south poles or windings 58, 59. The magnets 54, 55 are circular in cross-section and are arranged so that their respective poles 56, 57 and 58, 59 are transverse to the circumference of the concentric circle defined by the magnets 54, 55. The rotor plates 51, 52 are fixedly interconnected by a rotor shaft 41 extending coaxially along the axis of rotation and journalled in suitable rotor shaft bearings 42 in the heads 5, 6.

Two each of the permanent magnets 54 and the electromagnets 55 are provided on each rotor 49, 50. The permanent magnets 54 are radially spaced at 180° intervals, as are the electromagnets 55. As shown in FIG. 3, the magnets 54, 55 are angled slightly whereby their respective poles 56, 57 and 58, 59 point in a direction opposite to the direction of rotation. Thus, the poles 56, 57 and 58, 59 of the magnets 54, 55 are selectively aligned with the ends 12 of the cylinders 11.

The first rotor 49 includes a plurality of arms 37 extending radially outwardly from a circumference thereof. One of the arms 37 mounts a perimeter electromagnet 53 with north and south poles or windings 63, 64 adapted for selective interaction with perimeter permanent magnets 43 mounted at radially-spaced intervals around the perimeter of the head 43 and having north and south poles 44, 45. The core material of the electromagnets 53, 55 is preferably nonferrous. The perimeter magnets 43, 53 are angled with respect to the axis of rotation of the pump 1 so that the perimeter head magnet poles 44, 45 extend in the direction of rotation of the rotors 49, 50 and the perimeter rotor electromagnet poles 63, 64 extend in a direction opposite thereto. The perimeter rotor magnet poles 63, 64 thus selectively align with perimeter head magnet poles 44, 45 to facilitate rotation of the rotors 49, 50 as the perimeter rotor electromagnet 53 is intermittently energized. A counterweight 48 is mounted on a rotor arm 37 diametrically opposite to the rotor arm 37 mounting the perimeter rotor electromagnet 53.

FIG. 1 shows an electrical distribution system 60 for selectively energizing the electromagnets 53, 55 as required to operate the pump 1. The electrical distribution system 60 includes a storage battery 61 operably connected to a rheostat 66 and an alternator 69. A wiring harness 65 interconnects the battery 61, the electrical contacts 47, the rheostat 66 and the alternator 69. Each rotor 49, 50 includes a plurality of electrical pickups 67 which are connected to respective electromagnets 53, 55 and selectively engage electrical contacts 47 whereby the electromagnets 53, 55 are selectively energized as the rotors 49, 50 rotate. A mechanical detent mechanism (not shown) is provided for stopping the rotors 49, 50 with the electrical pickups 67 in contact with respective electrical contacts 47 when current is discontinued to the electromagnets 53, 55 and the rotors 49, 50 stop. The pump 1 is grounded to the negative side of the battery 61.

In operation, the perimeter electromagnet 53 is selectively energized to turn the interconnected rotors 49, 50. The angular orientation of the perimeter magnets 43, 53 establishes the direction of rotation, i.e. counterclockwise when viewed in the orientation shown in FIG. 4. Thus, the magnetic orientations of the perimeter magnets 43, 53 are such that they repel each other. However, rotation of the rotors 49, 50 is enhanced by utilizing the attractive and repulsive magnetic forces between the magnets 30, 54 and 55.

As the rotors 49, 50 rotate, their respective magnets 54, 55 are brought into alignment with respective piston magnets 30. The rotor electromagnets 55 attract respective piston permanent magnets 30 and the rotor permanent magnets 54 repel the piston permanent magnets 30. Thus, each piston assembly 29 is simultaneously being repelled by a respective permanent magnet 54 on one side and attracted by a respective electromagnet 55 on the other side. Because of the alternating spacing of the two each permanent magnets 54 and electromagnets 55 on each rotor 49, 50, each one-fourth turn (90°) of the interconnected rotors 49, 50 results in a single stroke of a respective piston assembly 29 and the corresponding displacement of an amount of fluid 68.

The valve members 19 are reciprocated by differential pressure in the fluid 68 whereby the inlet valve assemblies 17 open as the piston assemblies 29 retract from their respective cylinder ends 12 and the outlet valve assemblies 18 open as the piston assemblies 29 extend into their respective cylinder ends 12. Thus, on each piston stroke respective inlet and outlet valve assemblies 17, 18 are open at opposite cylinder ends 12 and the other inlet and outlet valve assemblies 17, 18 remain closed.

Each piston assembly 29 moves in synchronization with a respective piston assembly 29 diametrically opposite to it. Thus, the diametrically opposite pairs of piston assemblies 29 are always moving in opposite directions to each other to dampen vibration of the pump 1 in operation.

As shown in FIG. 3, the cylinders 11 are longitudinally curved whereby their respective midsections 13 protrude from their ends 12 in a direction opposite to the direction of rotation of the rotors 49, 50. The rotor magnets 54, 55 are correspondingly angled with respect to the rotor axis of rotation whereby the rotor magnets 54, 55 selectively align with respective cylinder ends 12. Thus, the desired interaction between the piston magnets 30 and the rotor magnets 54, 55 is enhanced and any tendency for the respective magnetic fields to interfere with or resist the desired reciprocation of the piston assemblies 29 and the rotation of the rotors 49, 50 is lessened.

The rotor electromagnets 55 are deenergized when they are directly aligned with respective piston assembly permanent magnets 30, which alignment corresponds to a respective piston assembly 29 reaching its greatest extension or end of travel. However, the timing of the energization of the electromagnets 53, 55 can be adjusted as required to optimize reciprocation of piston assemblies 29 and rotation of the rotors 49, 50.

The fluid 68 lubricates the piston assemblies 29, enhances magnetic flux and tends to cool the pump 1. Fluid is provided to the inlet valves 17 by an inlet manifold 70.

The orientations of the respective permanent magnets 54 and electromagnets 55 may be reversed whereby the piston magnets 30 are respectively attracted and repelled by the permanent magnets 44 and the electromagnets 53. Likewise, the cylinders 11 can be longitudinally straight and the rotor magnets 54, 55 can be mounted with their respective poles 56, 57 and 58, 59 parallel to the rotor rotational axis and perpendicular to the rotor plates 51, 52. Furthermore, the cylinders 11 can be longitudinally straight and the rotor magnets 54, 55 can be mounted in the angular orientations previously described for efficient rotor movement and general operation due to attraction between the rotor electromagnets 55 and the piston magnets 30. Although four cylinders 11 are shown, other numbers of cylinders could be provided and fall within the scope of the present invention. However, an even number of cylinders is preferred for smooth and balanced operation of the pump 1. When the device is started, the perimeter rotor electromagnet 53 is energized and is repelled by a respective perimeter head magnet 43. Rotary motion is maintained by intermittent energization of the perimeter rotor electromagnet 53 and interaction between the piston magnets 30 and the rotor magnets 54, 55.

The pump 1 may be used for pumping or compressing fluid in any appropriate application. For example, FIG. 1 discloses a system 71 wherein the pump 1 is operably connected to an hydraulic motor 72. Excess fluid 68 is contained in a reservoir 73. A check valve 74 is provided between the fluid motor 72 and the reservoir 73. The fluid is conveyed between the components of the system 71 by fluid lines 76. Thus, the inlet valve assemblies 17 communicate with the reservoir 73, the outlet valve assemblies 18 communicate with the fluid motor 72 and the fluid motor 72 communicates with the reservoir 73 through the fluid lines 76. The fluid lines 76 communicate with the outlet fluid chamber 26 in the central tube 25.

Although the rotors 49, 50 are shown with equal numbers of permanent magnets 54 and electromagnets 55, the present invention could function with all electromagnets. However, the balanced mix of permanent magnets 54 and electromagnets 55 is preferred because the electromagnets 55 provide control of the rotor speed through the rheostat 66 and the permanent magnets 54 do not require the power consumption of the electromagnets 53, 55 for operation. Thus, an appropriate balance is struck wherein both types of magnets are utilized to advantage.

The pump 1 is mounted by mounts 78 connected to a respective cylinder 11. Multiple motorized pumps 1 can be coupled together at their respective rotors for creating composite motorized pump units with greater power and work capacity.

It is to be understood that while certain forms of the present invention have been illustrated and described herein, it is not to be limited to the specific forms or arrangement of parts described and shown.

What is claimed and desired to be secured by Letters Patent is as follows:

1. A motorized pump, which comprises:

(a) a cylinder including inlet and outlet orifices and an end;

(b) inlet and outlet valves selectively opening and closing said inlet and outlet orifices respectively;

(c) a piston assembly reciprocably positioned in said cylinder and including:

(1) a magnet having a pair of poles extending towards said cylinder end; and (2) disc means attached to said magnet and adapted for fitting relatively closely with said cylinder;

(d) a cylinder head mounted on said cylinder end in substantialy fluid-tight engagement therewith;

(e) a rotor rotatably mounted on said pump in proximity to said head and including:

(1) a permanent magnet including a pair of poles adapted for selective alignment with said pisotn magnet poles; and (2) an electromagnet positioned in radially spaced relation from said permanent magnet and including a pair of poles adapted for selective alignment with said piston magnet poles;

(f) said permanent magnet and said electromagnet being positioned on a ring concentric with an axis of rotation of said rotor; and (g) electrical means adapted for selectively energizing said electromagnet.

2. A motorized pump, which comprises:

(a) a plurality of cylinders positioned in radially-spaced relation, each said cylinder including:

(1) opposite first and second ends;

(2) a midsection positioned between said ends;

(3) a pair of inlet orifices each located in proximity to a respective end; and (4) a pair of outlet orifices each located in proximity to a respective end;

(b) inlet and outlet valves selectively opening and closing said inlet and outlet orifices respectively;

(c) a plurality of piston assemblies each reciprocably positioned in a respective cylinder and including:

(1) a pair of magnets each having a pair of poles extending towards a respective cylinder end;

(2) magnet connection means adapted for interconnecting said magnets; and (3) disc means attached to said magnets and adapted for fitting relatively closely with said cylinder;

(d) first and second cylinder heads mounted on said first and second cylinder ends respectively in substantially fluid-tight engagement therewith;

(e) first and second rotors rotatably mounted on said pump in proximity to said first and second heads respectively, each said rotor including:

(1) a plurality of radially-spaced permanent magnets each including a pair of poles adapted for selective alignment with respective piston magnet poles; and (2) a plurality of radially-spaced electromagnets each including a pair of poles adapted for selective alignment with respective piston magnet poles;

(f) said permanent magnets and electromagnets forming a ring concentric with an axis of rotation of said rotor, said ring comprising said permanent magnets and said electromagnets in alternating sequence; and (g) electrical means adapted for selectively energizing said electromagnets.

3. The pump according to claim 2 wherein:

(a) said rotor permanent magnets selectively repel said piston assemblies; and (b) said rotor electromagnets selectively attract said piston assemblies.

4. The pump according to claim 2 wherein:

(a) said cylinders are longitudinally curved with said midsections thereof extending from said cylinder ends in a direction opposite to the direction of rotation of said rotors.

5. The pump according to claim 4 wherein:

(a) said rotor magnets are mounted on said rotors with angular orientations whereby their respective poles selectively align with respective piston magnets.

6. The pump according to claim 2 wherein:

(a) said inlet and outlet valves comprise differential pressure valves which are actuated by differential fluid pressure.

7. The pump according to claim 2 wherein said electrical means includes:

(a) a pair of electrical contact rings each mounted on a respective said head and including a plurality of radially-spaced electrical contacts concentric with said rotor axis of rotation; and (b) a pair of electrical pickups each mounted on a respective rotor and adapted for engaging said electrical contact ring, said pickups being operably connected to said electromagnets whereby said electromagnets are selectively energized by electricity communicated thereto through said electrical contact rings and said pickups.

8. The pump according to claim 2, which includes:

(a) a perimeter head magnet mounted on said head in proximity to a perimeter thereof;

(b) a perimeter rotor magnet mounted on said first rotor in proximity to a perimeter thereof; and (c) said perimeter magnets being adapted for selective interaction whereby said first rotor is rotated with respect to said heads.

9. The pump according to claim 8, which includes:

(a) a radially-spaced plurality of said perimeter head magnets comprising permanent magnets; and (b) said perimeter rotor magnet comprising an electromagnet adapted for selectively repelling said perimeter head permanent magnets when energized.

10. The pump according to claim 8 wherein:

(a) said head and rotor magnets include poles angled with respect to said axis of rotation whereby rotation of said first rotor is facilitated.

11. The pump according to claim 2, which includes:

(a) a rotor shaft journalled in said heads and fixedly connected to said rotors whereby rotary motion imparted to said first rotor is transferred to said second rotor.

12. The pump according to claim 8, which includes:

(a) said first rotor having a pair of arms extending radially outwardly from the perimeter thereof, one of said arms mounting said perimeter rotor magnet and the other of said arms being positioned diametrically opposite to said first arm; and (b) a counterweight mounted on said other arm.

13. The pump according to claim 2, which includes:

(a) a centrally-located tube extending between said heads and defining an outlet fluid chamber, said chamber communicating with said outlet valves.

14. The pump according to claim 2 wherein said electrical means includes:

(a) electrical source means; and (b) a rheostat connected to said electrical source means for controlling the rotational speed of said rotors.

15. The pump according to claim 2 wherein said means for occluding said cylinder includes:

(a) a pair of piston discs each mounted on the poles of a respective said piston magnet; and (b) a pair of piston rings each mounted on a respective piston disc and slidably engaging said cylinder.

16. A motorized pump, which comprises:

(a) a plurality of cylinder assemblies positioned in radially-spaced relation, each cylinder assembly including:

(1) a cylinder comprising a non-ferrous material with opposite first and second ends and a midsection with longitudinally-extending grooves, said cylinder having a curved configuration defining a longitudinally-extending arc with said ends longitudinally aligned with respect to said motorized pump and said midsection protruding from alignment with said ends;

(2) a pair of inlet orifices each at a respective end;

(3) a pair of outlet orifices each at a respective cylinder end;

(4) a pair of inlet valve assemblies each at a respective cylinder end and including an inlet valve member adapted to selectively cover a respective inlet orifice; and (5) a pair of outlet valve assemblies each at a respective cylinder end and including an outlet valve member adapted to selectively cover a respective outlet orifice;

(b) a plurality of piston assemblies each ihcluding:

(1) a pair of permanent magnets each having a pair of poles extending towards a respective cylinder end;

(2) a spacer positioned between said permanent magnets and including ends slidably received in respective cylinder grooves;

(3) a pair of piston discs each positioned over said poles of a respective magnet and substantially occluding said cylinder; and (4) piston connection means adapted for interconnecting said magnets, spacer and discs;

(c) a first head mounted on said first ends of said cylinders in substantially fluid-tight engagement therewith, said first head including:

(1) a concentric ring including a plurality of radially-spaced electrical contacts; and (2) a plurality of perimeter magnets mounted at radially-spaced intervals around a perimeter of said head;

(d) a second-head mounted on said cylinder second ends in substantially fluid-tight engagement therewith and including a concentric ring with radially-spaced electrical contacts;

(e) a first rotor mounted in closely-spaced relation to said first head and including:

(1) a plurality of radially-spaced permanent magnets adapted for selective alignment with respective piston magnets;

(2) a plurality of radially-spaced electromagnets adapted for selective alignment with respective piston magnets;

(3) said permanent magnets and said electromagnets being positioned in alternating sequence in a concentric ring on said first rotor and including respective poles extending transversely with respect to said ring;

(4) a perimeter electromagnet mounted on a perimeter of said rotor and adapted for selective alignment with said perimeter head magnets; and (5) an electrical pickup engaging said electrical distribution ring for selective engagement with said electrical contacts thereon, said pickup being operably connected to said first rotor electromagnets whereby said first rotor electromagnets are selectively energized by electricity from said ring; and (f) a second rotor mounted in closely-spaced relation to said second head and including:

(1) a plurality of radially-spaced permanent magnets adapted for selective alignment with respective piston magnets;

(2) a plurality of radially-spaced electromagnets adapted for selective alignment with respective piston magnets; p2 (3) said permanent magnets and said electromagnets being positioned in alternating sequence in a concentric ring on said second rotor and including respective poles extending transversely with respect to said ring; and (4) an electrical pickup engaging said electrical distribution ring for selective engagement with said electrical contacts thereon, said pickup being operably connected to said second rotor electromagnets whereby said second rotor electromagnets are selectively energized by electricity from said ring.

* * * * *

UNITED STATES PATENT AND TRADEMARK OFFICE

CERTIFICATE OF CORRECTION

PATENT NO. : 4,671,745

DATED : Jun. 9, 1987

INVENTOR(S) : Raymond H. Smith

It is certified that error appears in the above-identified patent and that said Letters Patent is hereby corrected as shown below:

ON THE TITLE PAGE, ITEM [76], should read

-- INVENTORS: Raymond H. Smith, Rte. 2, 5AAA
Larned, Kans. 67550 --and
Donald E. Bryant, Rte. 1, Box 2
Garfield, Kans. 67529--

Signed and Sealed this

Nineteenth Day of January, 1988

*Attest:*

DONALD J. QUIGG

*Attesting Officer*

*Commissioner of Patents and Trademarks*